US009228723B2

(12) United States Patent
Clifton et al.

(10) Patent No.: US 9,228,723 B2
(45) Date of Patent: Jan. 5, 2016

(54) DOWNLIGHT FIXTURES

(71) Applicant: ABL IP Holding LLC, Conyers, GA (US)

(72) Inventors: David Wiley Clifton, Conyers, GA (US); Larry Michael Bell, Brooks, GA (US); Glen Andrew Kruse, Snellville, GA (US); Douglas Dewayne Grove, Grayson, GA (US); Yan Rodriguez, Suwanee, GA (US); Jeff R. Shaner, Covington, GA (US)

(73) Assignee: ABL IP Holding LLC, Conyers, GA (US)

( * ) Notice: Subject to any disclaimer, the term of this patent is extended or adjusted under 35 U.S.C. 154(b) by 180 days.

(21) Appl. No.: 13/829,589

(22) Filed: Mar. 14, 2013

(65) Prior Publication Data

US 2013/0258685 A1 Oct. 3, 2013

Related U.S. Application Data

(60) Provisional application No. 61/685,924, filed on Mar. 27, 2012.

(51) Int. Cl.

| | |
|---|---|
| ***F21V 15/00*** | (2015.01) |
| ***F21V 15/04*** | (2006.01) |
| ***F21S 8/02*** | (2006.01) |
| ***F21V 21/04*** | (2006.01) |

(Continued)

(52) U.S. Cl.

CPC ..... *F21V 15/04* (2013.01); *F21S 8/026* (2013.01); *F21V 19/00* (2013.01); *F21V 21/044* (2013.01); *F21V 29/70* (2015.01); *F21V 29/004* (2013.01); *F21Y 2101/02* (2013.01); *Y10T 29/49876* (2015.01)

(58) Field of Classification Search

CPC ..... F21S 8/026; F21V 15/04; F21V 19/00; F21V 21/044; F21V 29/004; F21V 29/22; F21Y 2101/02

USPC ..... 362/370, 368

See application file for complete search history.

(56) References Cited

U.S. PATENT DOCUMENTS 5,068,772 A 11/1991 Shapiro et al.
5,609,414 A * 3/1997 Caluori ..... 362/366

(Continued)

FOREIGN PATENT DOCUMENTS

DE 3536180 4/1987
EP 2463578 6/2012

(Continued)

OTHER PUBLICATIONS

Office Action for Canadian Application No. CA 2,810,050, mailed Oct. 9, 2014 (5 pages).

(Continued)

*Primary Examiner* — Evan Dzierzynski
*Assistant Examiner* — Tsion Tumebo
(74) *Attorney, Agent, or Firm* — Kilpatrick Towsend & Stockton, LLP

(57) ABSTRACT

Retrofit light fixtures suitable for installation without tools. One or more spring bands deform as the fixture is forced through a ceiling opening and resume their preloaded shape to hold the fixture in place. Some embodiments may be installed in round ceiling openings and may utilize LED light sources.

21 Claims, 5 Drawing Sheets

(51) Int. Cl.

| | |
|---|---|
| ***F21V 19/00*** | (2006.01) |
| ***F21V 29/70*** | (2015.01) |
| *F21V 29/00* | (2015.01) |
| *F21Y 101/02* | (2006.01) |

(56) References Cited

U.S. PATENT DOCUMENTS

| | | | | |
|---|---|---|---|---|
| 5,957,572 | A * | 9/1999 | Wedekind et al. | 362/365 |
| 6,364,511 | B1 * | 4/2002 | Cohen | 362/368 |
| 6,421,904 | B1 | 7/2002 | Wedekind et al. | |
| 6,588,922 | B1 | 7/2003 | DeCicco | |
| 7,744,256 | B2 * | 6/2010 | Smester | 362/362 |
| 7,972,043 | B2 | 7/2011 | Schutte | |
| 8,042,973 | B2 | 10/2011 | Inoue et al. | |
| 8,641,243 | B1 * | 2/2014 | Rashidi | 362/373 |
| 2004/0257818 | A1 | 12/2004 | Benghozi | |
| 2005/0225966 | A1 | 10/2005 | Hartmann et al. | |
| 2009/0080189 | A1 * | 3/2009 | Wegner | 362/235 |
| 2009/0207623 | A1 * | 8/2009 | Schutte | 362/365 |
| 2010/0061108 | A1 | 3/2010 | Zhang et al. | |
| 2010/0110699 | A1 | 5/2010 | Chou | |
| 2010/0226139 | A1 | 9/2010 | Lynch et al. | |
| 2011/0002115 | A1 | 1/2011 | Okamura et al. | |
| 2011/0019429 | A1 | 1/2011 | Okamura et al. | |
| 2011/0069499 | A1 | 3/2011 | Trott et al. | |
| 2011/0075414 | A1 | 3/2011 | Van De Ven et al. | |
| 2011/0222291 | A1 | 9/2011 | Peng | |
| 2011/0267826 | A1 | 11/2011 | Santiago et al. | |
| 2013/0215623 | A1 * | 8/2013 | Goodman et al. | 362/341 |

FOREIGN PATENT DOCUMENTS

| | | |
|---|---|---|
| JP | 56116204 | 9/1961 |
| JP | 2008059815 | 3/2008 |

OTHER PUBLICATIONS

Extended European Search Report for European Application No. EP 13161469.5, mailed May 23, 2013 (8 pages).

Office Action for Canadian Application No. 2,810,050, mailed Jun. 1, 2015 (3 pages).

* cited by examiner

DOWNLIGHT FIXTURES

CROSS REFERENCE TO RELATED APPLICATIONS

This application is related to and claims priority benefits from U.S. Provisional Application Ser. No. 61/685,924, filed on Mar. 27, 2012, entitled "Downlight Fixtures" ("the '924 application"). The '924 application is hereby incorporated in its entirety by this reference.

FIELD OF THE INVENTION

The field of the invention relates to lighting fixtures and the retrofitting of light fixtures in ceiling openings and the like.

BACKGROUND

Known methods and apparatuses for installing downlight fixtures into ceiling openings and the like traditionally require an assortment of tools and hardware, in addition to a certain amount of corresponding dexterity. These necessities are especially troublesome given that an installer performing such an installation is typically also preoccupied with holding the light fixture(s) to be installed and maintaining his or her balance on a height support, such as a ladder, lift, or chair, during the installation process. Thus, it may be desirable to provide a downlight fixture that can be installed easily with without tools or hardware. This is especially true now as many consumers are upgrading their downlight fixtures from a conventional light source fixture to an LED light source fixture.

SUMMARY

Certain embodiments of the present invention include a retrofit light fixture for insertion within an opening, the retrofit light fixture having a mounting ring, a support frame coupled to the mounting ring, and at least one spring band coupled to the mounting ring, wherein, the at least one spring band is adapted to deflect inwardly to permit insertion of the retrofit light fixture into the opening and, after insertion, to return to its preloaded state to resist removal of the retrofit light fixture from the opening. In some embodiments, the retrofit light fixture may also have a housing for housing light sources and a heat sink for heat dissipation.

In some embodiments, the retrofit light fixture may have two or more spring bands. For example, in some embodiments, the retrofit light fixture may have three spring bands. In some embodiments, the at least one spring band may be formed of stainless steel or spring steel.

In some embodiments, the retrofit light fixture may have a mounting plate and/or centering pin or bolt to ensure the spring bands remained centered during insertion through the opening.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures.

DETAILED DESCRIPTION

Figure 1:
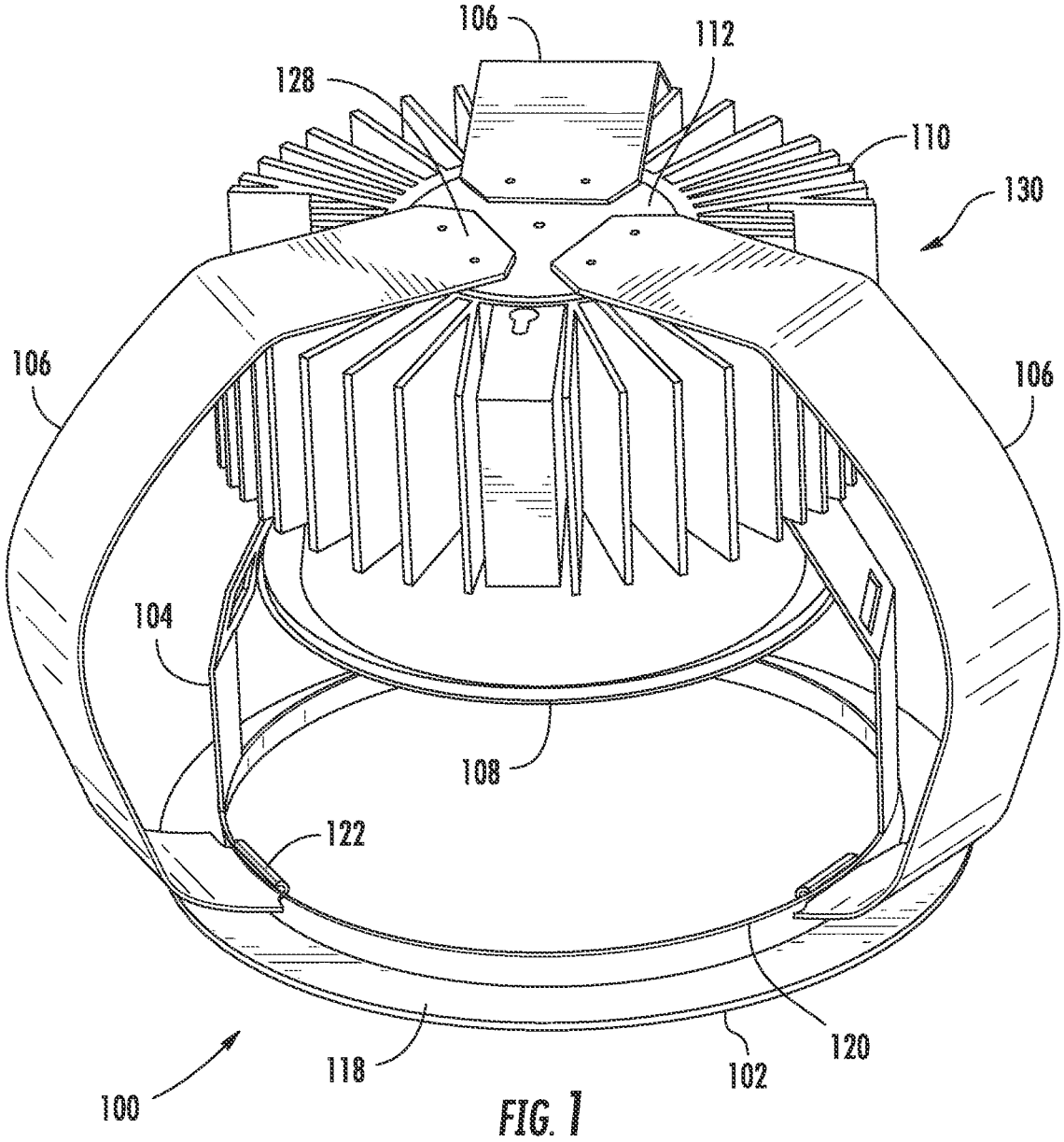
FIG. 1 is a top and side perspective view of a first embodiment of a retrofit light fixture of this invention.
Figure 2:
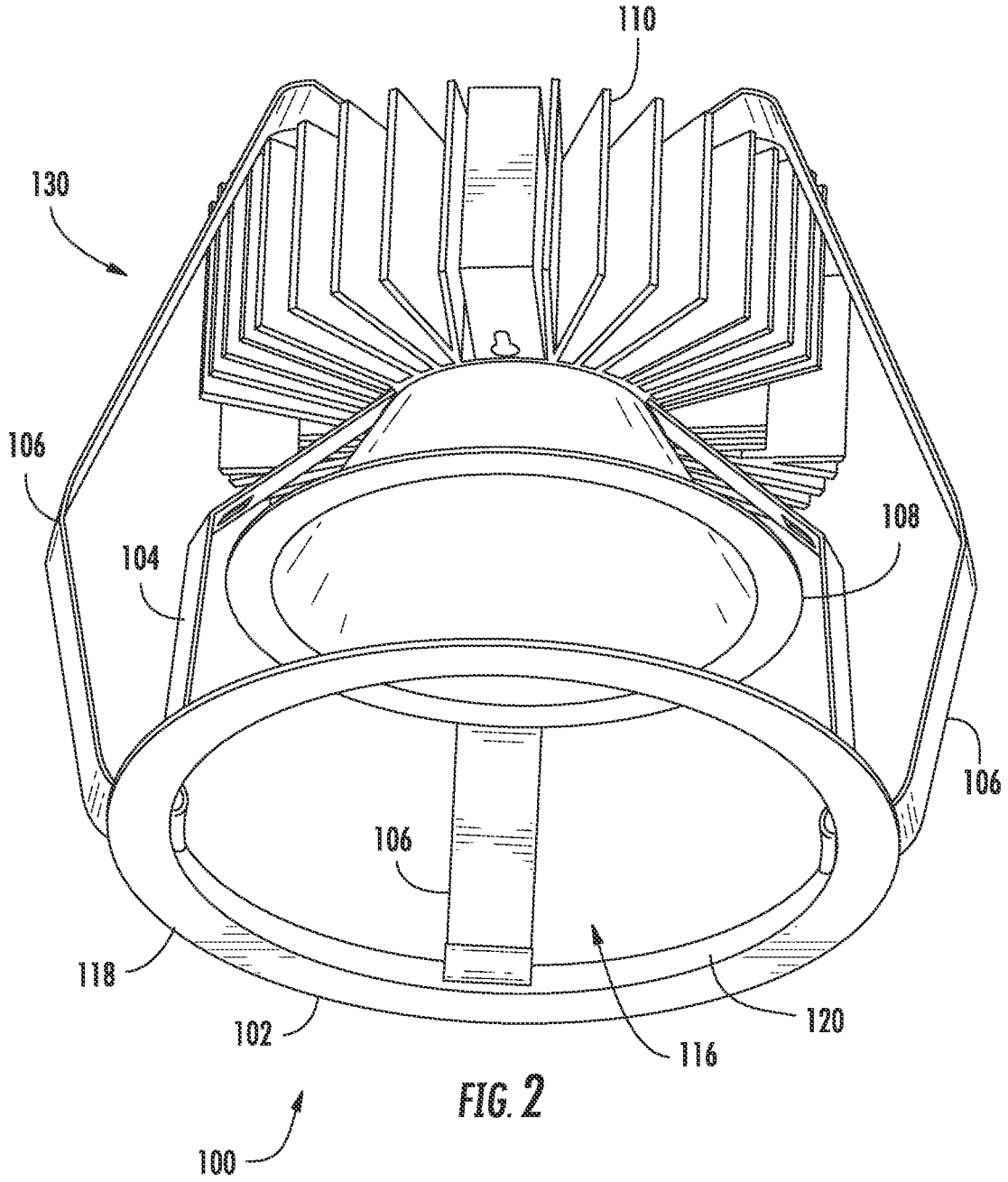
FIG. 2 is a bottom and side perspective view of the retrofit light fixture of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of this invention provide retrofit light fixtures. While the retrofit light fixtures are generally discussed for use with downlight fixtures that are recessed in ceiling, they are by no means so limited. Rather, embodiments of the retrofit light fixtures may be used in connection with any fixture or apparatus sought to be retrofitted into an opening.

FIGS. 1-6 illustrate embodiments of a retrofit light fixture 100. In these embodiments, the retrofit light fixture 100 may have a mounting ring 102, a support frame 104 coupled to the mounting ring 102, three spring bands 106 coupled to the mounting ring 102, and a housing 108 for housing one or more light sources, such as one or more light-emitting diodes (LEDs). In some embodiments, such as the embodiments illustrated in FIGS. 1-6, the retrofit light fixture 100 may also have a heat sink 110 for heat dissipation. In some embodiments, the retrofit light fixture 100 may include fewer or more than three spring bands 106.

The retrofit light fixture 100 is designed to be retrofitted into an existing ceiling 200 opening 202 and/or opening of an existing mounting frame (not shown) without the use of any tools or hardware. The spring bands 106 are configured to deflect inward (e.g., toward housing 108) during insertion of the retrofit light fixture 100 through the opening 202. Use of a mounting plate 112 and/or a centering pin or bolt 114, provided in some embodiments and depicted in FIGS. 3-5, may help to ensure the spring bands 106 remained centered during insertion through the opening 202 (i.e., prevent the spring bands 106 from shifting laterally). After insertion, the spring bands 106 may return to their preloaded state to help retain the retrofit light fixture 100 in the ceiling 200. In some embodiments, such as the embodiments illustrated in FIG. 5, a trim piece 300 may be inserted into the retrofit light fixture 100 to impart a finished or polished appearance to the installation.

The mounting ring 102 trims the ceiling 200 opening 202 with a vertical portion 120 that extends into the opening 202 and a flange-shaped portion 118 that lies against an underside 206 of the ceiling 200. The mounting ring 102 also defines an entry 116 of the retrofit light fixture 100. The dimensions of the mounting ring 102 may vary depending on the opening 202 dimensions. In some embodiments, such as the embodiments illustrated in FIGS. 1-6, the mounting ring 102 may have a circular shape. In other embodiments, the shape of the mounting ring 102 may resemble an oval, square, rectangle, triangle, or other similar polygon shape. The mounting ring 102 may be formed of materials including but not limited to plastics, composite plastics, steel, aluminum or other metals or metallic materials, composite materials, or other similar materials.

The flange 118 and vertical portion 120 may assist in the retrofitting of the retrofit light fixture 100. In these embodiments, the flange 118 may extend away from the entry 116 of the retrofit light fixture 100, while the vertical portion 120 may extend within the entry 116. In some embodiments, such as the embodiments illustrated in FIGS. 1-6, the flange 118 may extend horizontally away from the entry 116. The flange 118 and vertical portion 120 may be integrally formed.

The support frame 104 is coupled to the mounting ring 102 and provides support and structure for the retrofit light fixture 100. For example, in some embodiments, the support frame 104 defines an area for the housing 108. In some embodiments, the support frame 104 provides support for the housing 108 and/or heat sink 110. The dimensions, shape, position, and/or configuration of the support frame 104 may vary. For example, in the embodiments illustrated in FIGS. 1-5, the support frame 104 is coupled to the vertical portion 120 of the mounting ring 102. The support frame 104 may be formed of materials including but not limited to plastics, composite plastics, steel, aluminum or other metals other metallic materials, composite materials, or other similar materials. The support frame 104 may be coupled to the mounting ring 102 by a variety of mechanisms, including but not limited to adhesives, hooks, bolts, fasteners, screws, welds, pins, and other similar mechanisms. In some embodiments, the support frame 104 may be integrally formed with the mounting ring 102.

The spring bands 106 permit insertion of the retrofit light fixture 100 into the opening 202 and then retain it there. Each spring band 106 is preloaded and shaped such that it may deflect or compress inward for installation of the retrofit light fixture 100 into the opening 202, but return to its preloaded state after such installation. In these embodiments, the at least one spring band 106 may be formed of any material possessing spring-like or biasing characteristics that permits the spring band 106 to deflect or compress inward when an external force is applied upon it, but also return to its preloaded state once the external force is removed. For example, in some embodiments, the spring band 106 may be formed of stainless steel or spring steel. Plastics, composite plastics, composite materials, and other similar materials may also be used.

Figure 5:
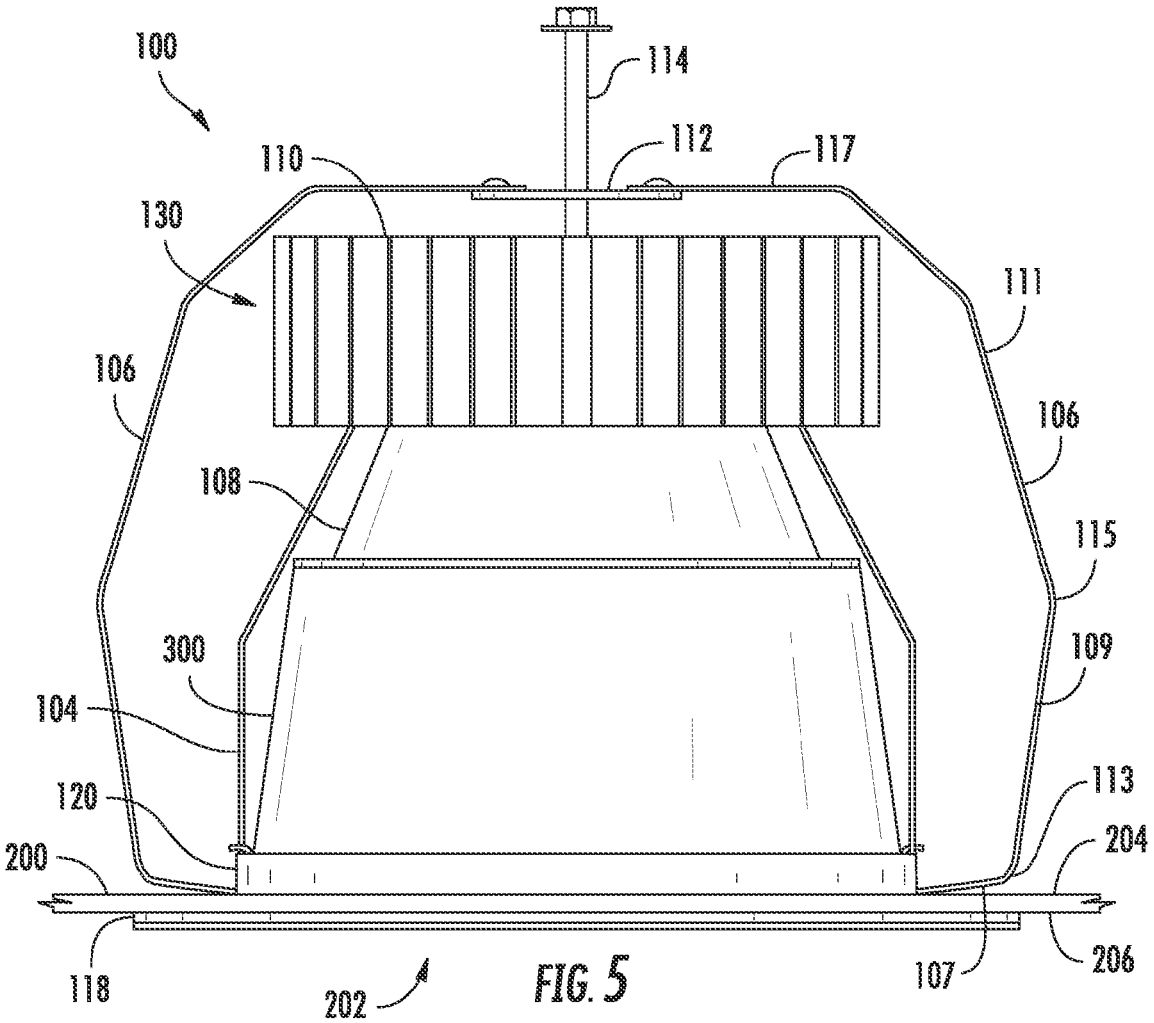
FIG. 5 is a side view of a third embodiment of retrofit light fixture of this invention.

The spring bands 106 may assume a number of different shapes provided that the relaxed or preloaded effective diameter of the fixture 100 exceeds the diameter of the opening within which the fixture 100 is to be installed (e.g., opening 202). Various generally "C" shapes or "U" shapes may be usable. As can be seen in the Figures, the spring bands 106 may have multiple generally straight sections 107, 109, 111, etc. joined at bends 113 and 115, etc. that cumulatively result in a top section 117 and a bottom section 107 being relatively horizontal (i.e., relatively parallel to the plane of the ceiling 200 within which the fixture 100 is installed). More or fewer straight sections 107, 109, 111, etc. could be used, and sharper or less sharp bends 113 and 115, etc. could also be used. Alternatively, the spring band 106 could utilize a smooth curve having a relatively constant radius or a curve with a changing radius. In most instances, however, it will be desirable for a section or portion of spring band 106 near its lower point of attachment to the rest of the fixture 100, such as bottom section 107 in FIG. 5, to project outward from the rest of the fixture 100 so that it extends over and can lie against an upper side 204 of the ceiling 200, as illustrated in FIG. 5.

The number of spring bands 106 may vary from one to several throughout embodiments. For example, in the embodiments illustrated in FIGS. 1-4, the retrofit light fixture 100 includes three spring bands 106. In some embodiments, such as the embodiments illustrated in FIG. 5, the retrofit light fixture 100 may have only two spring bands 106. In other embodiments, the retrofit light fixture 100 may have four or more spring bands 106. In yet other embodiments, the retrofit light fixture 100 may have only a single spring band 106. In some embodiments having two or more spring bands 106, the spring bands 106 may be positioned evenly about the mounting ring 102. For example, in the embodiments illustrated in FIGS. 1-4, each of the three spring bands 106 is positioned approximately every 120 degrees about the mounting ring 102. By contrast, in the embodiments illustrated in FIG. 5, the two spring bands 106 are positioned approximately 180 degrees apart.

Figure 6:
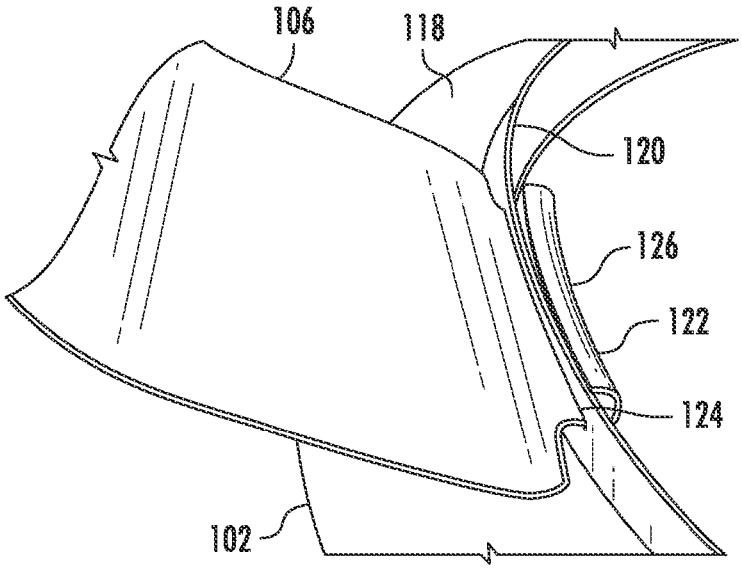
FIG. 6 is an enlarged perspective view an embodiment of the spring band to mounting ring coupling of the present invention.

The spring bands 106 may be coupled to mounting ring 102 in a variety of ways. For example, in some embodiments, such as the embodiments illustrated in FIGS. 1-6, a first end 122 of the spring band 106 may be coupled to the vertical portion 120 of the mounting ring 102. In some embodiments, such as the embodiments illustrated in FIGS. 1-6, the first end 122 of the spring band 106 may pass through a slot 124 in vertical portion 120 from the outside and curve up and back to form a hook 126, as best illustrated in FIG. 6. In these embodiments, because the spring band 106 protrudes from slot 124 a little above and at an acute angle to the plane of the flange 118, the upper side 204 of ceiling 200 may be trapped or pinched between the spring band 106 and the flange 118 during installation of the fixture 100, thereby securing fixture 100 to the ceiling 200.

Figure 3:
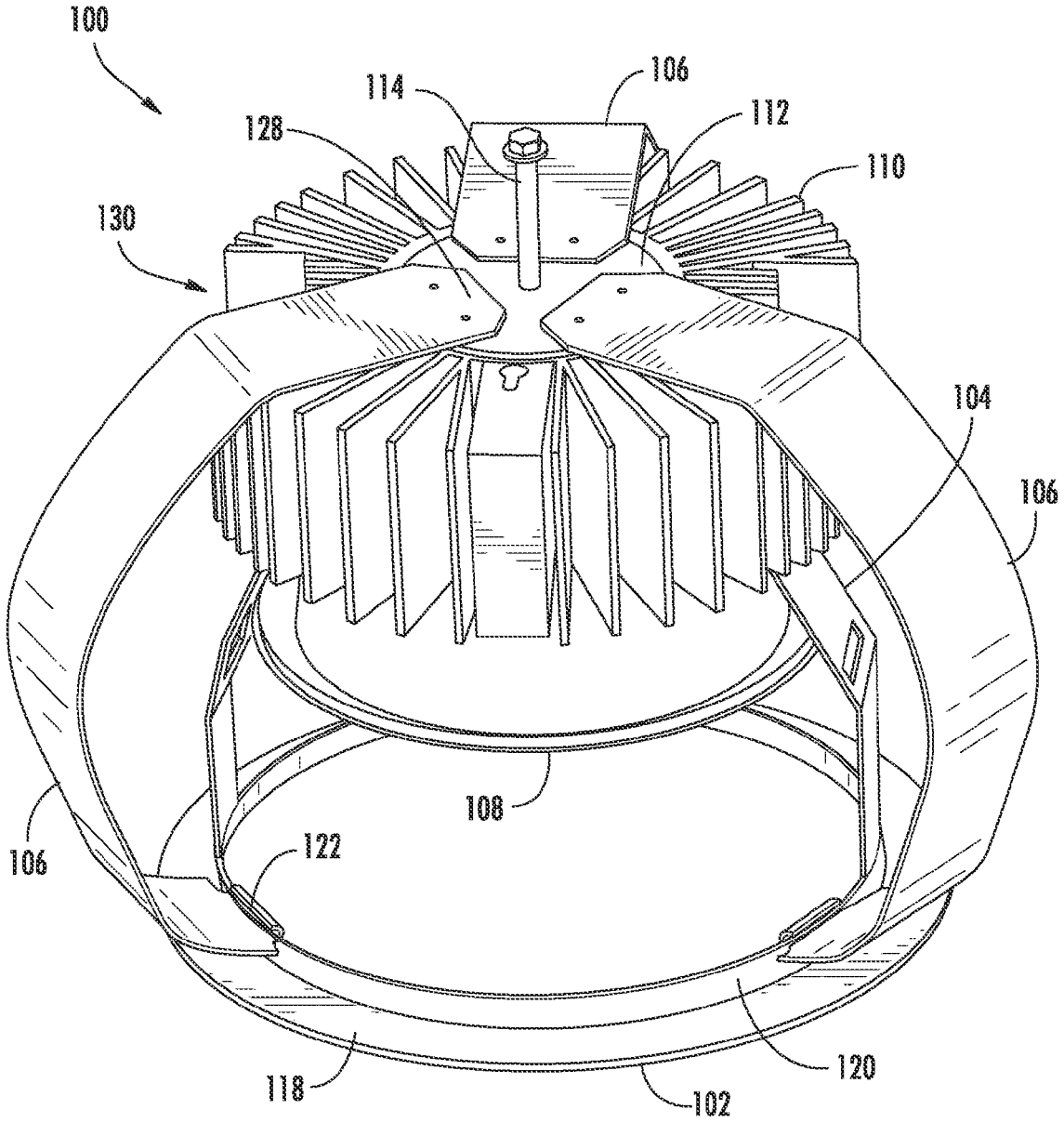
FIG. 3 is a top and side perspective view of a second embodiment of a retrofit light fixture of this invention with its spring bands shown in their preloaded state.
Figure 4:
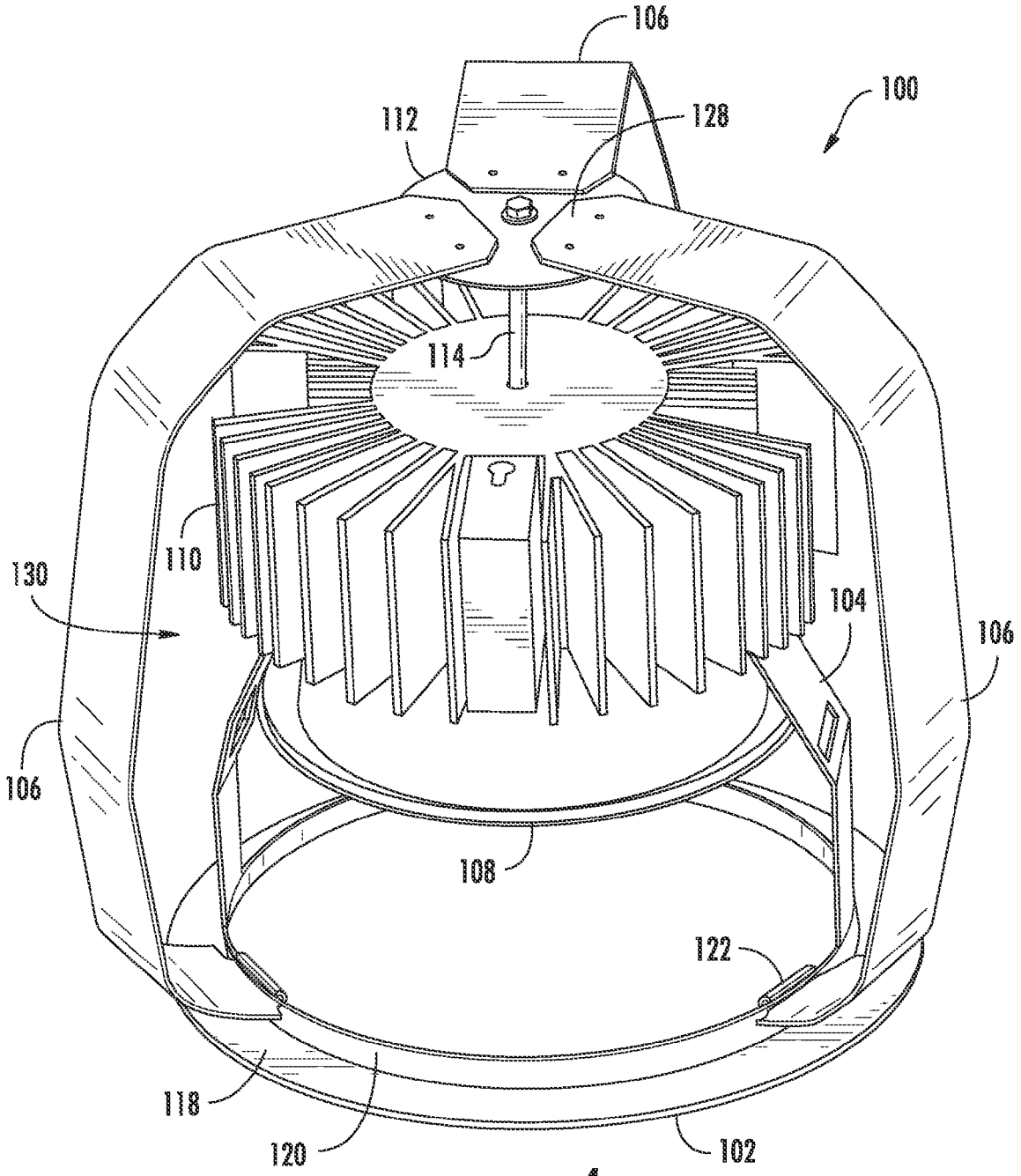
FIG. 4 is another perspective view of the retrofit light fixture of FIG. 3 with its spring bands shown deflected inward.

A second end 128 of the spring band 106 may be coupled to an upper portion 130 of the retrofit light fixture 100 to ensure consistent compression and decompression of the spring band 106. In some embodiments, the second end 128 of each spring band 106 may be attached to the heat sink 110. In other embodiments, the second end 128 of each spring band 106 may be attached to the support frame 104. In some embodiments, the second end 128 of each spring band 106 may be attached to the mounting plate 112 centered on the upper portion 130 of fixture 100. The mounting plate 112 may be permanently fixed to heat sink 110 as shown in FIG. 1, or may be permitted to go up and down centering pin or bolt 114, as illustrated in FIGS. 3-4.

The centering pin or bolt 114 may permit vertical movement of the mounting plate 112, and thereby second ends 128 of the spring bands 106, during installation of the retrofit light fixture 100, but also ensure the spring bands 106 remained centered relative to the balance of the retrofit light fixture 100 by preventing the spring bands 106 from shifting laterally. The centering pin or bolt 114 may also facilitate the inward deflection or compression of the spring bands 106 relative to the retrofit light fixture 100, and thereby the overall installation process, by displacing the second ends 128 of the spring bands 106 away from the opening 202, as illustrated in FIG. 4.

In embodiments having only a single spring band 106, the single spring band 106 may surround the upper portion 130 of the retrofit light fixture 100 such that the second end 128 of the single spring band 106 couples to a different portion of the mounting ring 102 than the first end 122, somewhat akin to embodiments having two spring bands 106, such as the embodiment illustrated in FIG. 5.

The retrofit light fixture 100 may also have a housing 108 configured and shaped to house one or more light sources, such as a plurality of LEDs (not shown). In these embodiments, the housing 108 may be coupled to the support frame 104. In some embodiments, the housing 108 may be integrally formed with the support frame 104. The housing 108 may be formed of materials including but not limited to plastics, composite plastics, steel, other metallic materials, composite materials, or other similar materials. The dimensions of the housing 108 may vary throughout embodiments, and in particular, may vary dependent on the light source to be housed within the housing 108.

As discussed above, the retrofit light fixture 100 may be installed into an existing ceiling opening, an opening of an existing mounting frame, a rough-cut hole in ceiling construction, and similar cavities, such as opening 202, without the use of any tools or hardware. For example, as illustrated in FIG. 5, the retrofit light fixture 100 may be inserted into the opening 202 using the spring bands 106. The span of the spring bands 106, as illustrated by example in FIGS. 1-3, may initially prevent the retrofit light fixture 100 from being fully inserted into the opening 202. As upward pressure is applied to the retrofit light fixture 100, however, an edge (not shown) of the opening 202 may engage and slide along the spring bands 106, causing the spring bands 106 to deflect or compress inwardly to provide the necessary clearance for the retrofit light fixture 100 to fully insert into the opening 202. In some embodiments, the use of the mounting plate 112 and/or the centering pin or bolt 114 may help facilitate the deflection or compression of the spring bands 106 and help ensure the spring bands 106 remained centered during insertion through the opening 202 (i.e., prevent the spring bands 106 from shifting laterally). Once the spring bands 106 clear the opening 202, the spring bands 106 may return to their relaxed or preloaded state, wherein they may help retain the retrofit light fixture 100 in the opening 202, as illustrated by example in FIG. 5, by abutting the ceiling 200 or frame (not shown). In this way, the retrofit light fixture 100 is easily retrofitted into existing frame or ceiling openings, and the like, from below, without the need for tools of other hardware. When the retrofit light fixture 100 is positioned in the opening 202 as described above, the mounting ring 102 seats against the ceiling 200 to trim the opening 202 and secure the fixture 100 in place.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A retrofit light fixture for insertion within an opening, the retrofit light fixture comprising:

(a) a mounting ring;

(b) a support frame attached to the mounting ring;

(c) a plate attached to an upper portion of the retrofit light fixture; and (d) at least one spring band with a lower end attached to the mounting ring and an upper end attached to the plate, wherein:

the at least one spring band is configured to deflect in a transverse direction to permit insertion of the retrofit light fixture in a longitudinal direction into the opening and, after insertion, to return to its preloaded state to resist removal of the retrofit light fixture from the opening;

the plate is configured to translate in the longitudinal direction with respect to the upper portion of the retrofit light fixture such that a gap is created between the upper portion of the retrofit light fixture and the plate;

the upper end of the spring band translates with the plate; and the longitudinal direction is approximately perpendicular to the transverse direction.

2. The retrofit light fixture of claim 1, wherein the at least one spring band is formed of stainless steel or spring steel.

3. The retrofit light fixture of claim 1, wherein the at least one spring band comprises two or more spring bands.

4. The retrofit light fixture of claim 3, wherein the at least one spring band comprises three spring bands.

5. The retrofit light fixture of claim 3, wherein the two or more spring bands are positioned evenly around a perimeter of the mounting ring.

6. The retrofit light fixture of claim 1 further comprising a housing attached to the support frame for housing one or more light sources.

7. The retrofit light fixture of claim 6 further comprising a heat sink coupled to the housing.

8. The retrofit light fixture of claim 7, wherein the housing and heat sink are integrally formed.

9. The retrofit light fixture of claim 1 further comprising a pin attached to the upper portion of the retrofit light fixture, wherein the plate comprises a hole such that the pin is disposed within the hole and the plate translates along the pin while the pin remains stationary.

10. The retrofit light fixture of claim 1, wherein the mounting ring comprises a flange portion and a vertical portion.

11. The retrofit light fixture of claim 10, wherein the lower end of the at least one spring band is attached to the vertical portion of the mounting ring and the upper end of the at least one spring band is attached to an upper surface of the plate of the retrofit light fixture.

12. A retrofit light fixture for insertion within an opening, the retrofit light fixture comprising:

(a) a mounting ring;

(b) a support frame attached to the mounting ring;

(c) a housing attached to the support frame;

(d) a heat sink attached to the housing;

(e) a plate attached to the heat sink; and (f) at least one spring band with a lower end attached to the mounting ring and an upper end attached to the plate, wherein:

the at least one spring band is configured to deflect in a transverse direction to permit insertion of the retrofit light fixture in a longitudinal direction into the opening and, after insertion, to return to its preloaded state to resist removal of the retrofit light fixture from the opening;

the plate is configured to translate in the longitudinal direction with respect to the retrofit light fixture such that a gap is created between the heat sink and the plate;

the upper end of the spring band translates with the plate; and the longitudinal direction is approximately perpendicular to the transverse direction.

13. The retrofit light fixture of claim 12, wherein the at least one spring band is formed of stainless steel or spring steel.

14. The retrofit light fixture of claim 12, wherein the at least one spring band comprises two or more spring bands.

15. The retrofit light fixture of claim 12, further comprising a pin attached to the heat sink, wherein the plate comprises a hole such that the pin is disposed within the hole and the plate translates along the pin while the pin remains stationary.

16. The retrofit light fixture of claim 15, wherein the lower end of the at least one spring band is attached to a vertical portion of the mounting ring and the upper end of the at least one spring band is attached to an upper surface of the plate.

17. A method of retrofitting a retrofit light fixture within an opening of a ceiling or frame, wherein the retrofit light fixture comprises a mounting ring; a support frame attached to the mounting ring; a plate attached to an upper portion of the retrofit light fixture; and at least one spring band with a lower end attached to the mounting ring, and an upper end attached to the plate, the method comprising: inserting the retrofit light fixture into the opening such that:

at least one edge of the opening causes the at least one spring band to deflect in a transverse direction to permit insertion of the retrofit light fixture in a longitudinal direction into the opening, wherein the longitudinal direction is approximately perpendicular to the transverse direction;

during deflection of the at least one spring band, the plate and the upper end of the spring band attached to the plate translate in the longitudinal direction with respect to the upper portion of the retrofit light fixture such that a gap is created between the upper portion of the retrofit light fixture and the plate; and wherein, after insertion, the at least one spring band is configured to return to its preloaded state to resist removal of the retrofit light fixture from the opening.

18. The method of claim 17, wherein the retrofit light fixture further comprises a housing attached to the support frame for housing one or more light sources and a heat sink attached to the housing.

19. The retrofit light fixture of claim 1, wherein:

the opening is circular;

the at least one spring band is configured to deflect such that the transverse direction intersects with a longitudinal centerline of the retrofit light fixture; and the deflection of the at least one spring band reduces an overall radius of the retrofit light fixture.

20. The retrofit light fixture of claim 1, wherein the at least one spring band comprises a plurality of straight sections and a plurality of bends disposed between and connecting the straight sections.

21. The retrofit light fixture of claim 1, wherein the lower end of the at least one spring band comprises a bent portion forming a hook such that the hook is configured to be inserted through a slot of the mounting ring.

* * * * *